US008587481B2

(12) United States Patent
Lai et al.

(10) Patent No.: US 8,587,481 B2
(45) Date of Patent: Nov. 19, 2013

(54) MOBILE WIRELESS DEVICE WITH ENLARGED WIDTH PORTION MULTI-BAND LOOP ANTENNA AND RELATED METHODS

(75) Inventors: Chun Kit Lai, Sunrise, FL (US); Milan Velimir Lukic, Sunrise, FL (US); Soo Liam Ooi, Sunrise, FL (US)

(73) Assignee: BlackBerry Limited, Waterloo, Ontario (CA)

( * ) Notice: Subject to any disclaimer, the term of this patent is extended or adjusted under 35 U.S.C. 154(b) by 391 days.

(21) Appl. No.: 13/009,214

(22) Filed: Jan. 19, 2011

(65) Prior Publication Data

US 2012/0032863 A1 Feb. 9, 2012

Related U.S. Application Data

(60) Provisional application No. 61/371,989, filed on Aug. 9, 2010.

(51) Int. Cl.
*H01Q 1/38* (2006.01)
*H01Q 1/24* (2006.01)
*H01Q 7/00* (2006.01)

(52) U.S. Cl.
USPC ..... 343/700 MS; 343/866; 343/702; 343/767

(58) Field of Classification Search
None
See application file for complete search history.

(56) References Cited

U.S. PATENT DOCUMENTS

| | | | | |
|---|---|---|---|---|
| 7,330,155 | B2 | 2/2008 | Chan et al. | 343/702 |
| 7,403,161 | B2 | 7/2008 | DiNallo et al. | 343/702 |
| 7,423,598 | B2 | 9/2008 | Bit-Babik et al. | 343/702 |
| 7,626,551 | B2 * | 12/2009 | Chien et al. | 343/700 MS |
| 7,642,964 | B2 | 1/2010 | DiNallo et al. | 343/700 |
| 7,928,915 | B2 * | 4/2011 | Sanz Arronte et al. | 343/700 MS |
| 2005/0007283 | A1 * | 1/2005 | Jo et al. | 343/702 |
| 2008/0055164 | A1 * | 3/2008 | Zhang et al. | 343/702 |
| 2008/0231530 | A1 * | 9/2008 | Rao et al. | 343/767 |
| 2009/0146905 | A1 * | 6/2009 | Morita | 343/895 |
| 2010/0019421 | A1 * | 1/2010 | Kenning et al. | 266/45 |
| 2012/0019421 | A1 * | 1/2012 | Lai et al. | 343/729 |
| 2012/0032857 | A1 * | 2/2012 | Lai et al. | 343/700 MS |

* cited by examiner

*Primary Examiner* — Trinh Dinh
(74) *Attorney, Agent, or Firm* — Allen, Dyer, Doppelt, Milbrath & Gilchrist, P.A.

(57) ABSTRACT

A mobile wireless communications device may include a portable housing, a printed circuit board (PCB) carried by the portable housing, and wireless transceiver circuitry carried by the PCB. The mobile wireless communications device also may include an antenna coupled to the wireless transceiver circuitry. The antenna may include a loop conductor, a first conductor body coupled to the loop conductor and extending into the interior thereof to define a first slotted opening with adjacent portions of the loop conductor, and a second conductor body coupled to the loop conductor and extending into the interior thereof to define a second slotted opening with adjacent portions of the loop conductor. The first and second conductor bodies may be spaced apart to define a third slotted opening therebetween. The first slotted opening may have an enlarged width portion adjacent the first conductive body.

19 Claims, 19 Drawing Sheets

60

SB
0.00
-5.00
-10.00
-15.00
-20.00
-25.00
-30.00
-35.00
0.50
1.00
1.50
2.00
2.50
3.00
FREQ [GHz]
m1
m2
m3
m4
NAME X Y
m1 0.9090 -4.1071
m2 1.7000 -11.9544
m3 1.9680 -30.6041
m4 2.2540 -8.1216

| NAME | FREQ | ANG | MAG | RX |
|---|---|---|---|---|
| m1' | 1.6220 | 114.5044 | 0.3648 | 0.6038 + 0.4624i |
| m2' | 2.4100 | 71.2419 | 0.4772 | 0.8387 + 0.9814i |
| m3' | 2.0500 | -19.7957 | 0.2144 | 1.4850 - 0.2261i |

| NAME | FREQ | ANG | MAG | RX |
|---|---|---|---|---|
| m1'' | 2.1900 | 124.6073 | 0.3695 | 0.5548 + 0.3908i |
| m2'' | 1.6650 | 163.1520 | 0.3775 | 0.4598 + 0.1173i |
| m3'' | 1.8640 | -72.1426 | 0.3560 | 0.9613 - 0.7460i |

MOBILE WIRELESS DEVICE WITH ENLARGED WIDTH PORTION MULTI-BAND LOOP ANTENNA AND RELATED METHODS

RELATED APPLICATION

The present application is based upon previously filed copending provisional application Ser. No. 61/371,989, filed Aug. 9, 2010, the entire subject matter of which is incorporated by reference in its entirety.

TECHNICAL FIELD

The present disclosure generally relates to the field of wireless communications systems, and, more particularly, to mobile wireless communications devices and related methods.

BACKGROUND

Mobile wireless communications systems continue to grow in popularity and have become an integral part of both personal and business communications. For example, cellular telephones allow users to place and receive voice calls almost anywhere they travel. Moreover, as cellular telephone technology has increased, so too has the functionality of cellular devices and the different types of devices available to users. For example, many cellular devices now incorporate personal digital assistant (PDA) features such as calendars, address books, task lists, etc. Moreover, such multi-function devices may also allow users to wirelessly send and receive electronic mail (email) messages and access the Internet via a cellular network and/or a wireless local area network (WLAN), for example.

Even so, as the functionality of cellular communications devices continues to increase, so too does the demand for smaller devices which are easier and more convenient for users to carry. One challenge this poses for cellular device manufacturers is designing antennas that provide desired operating characteristics within the relatively limited amount of space available for antennas.

DETAILED DESCRIPTION

Figure 1:
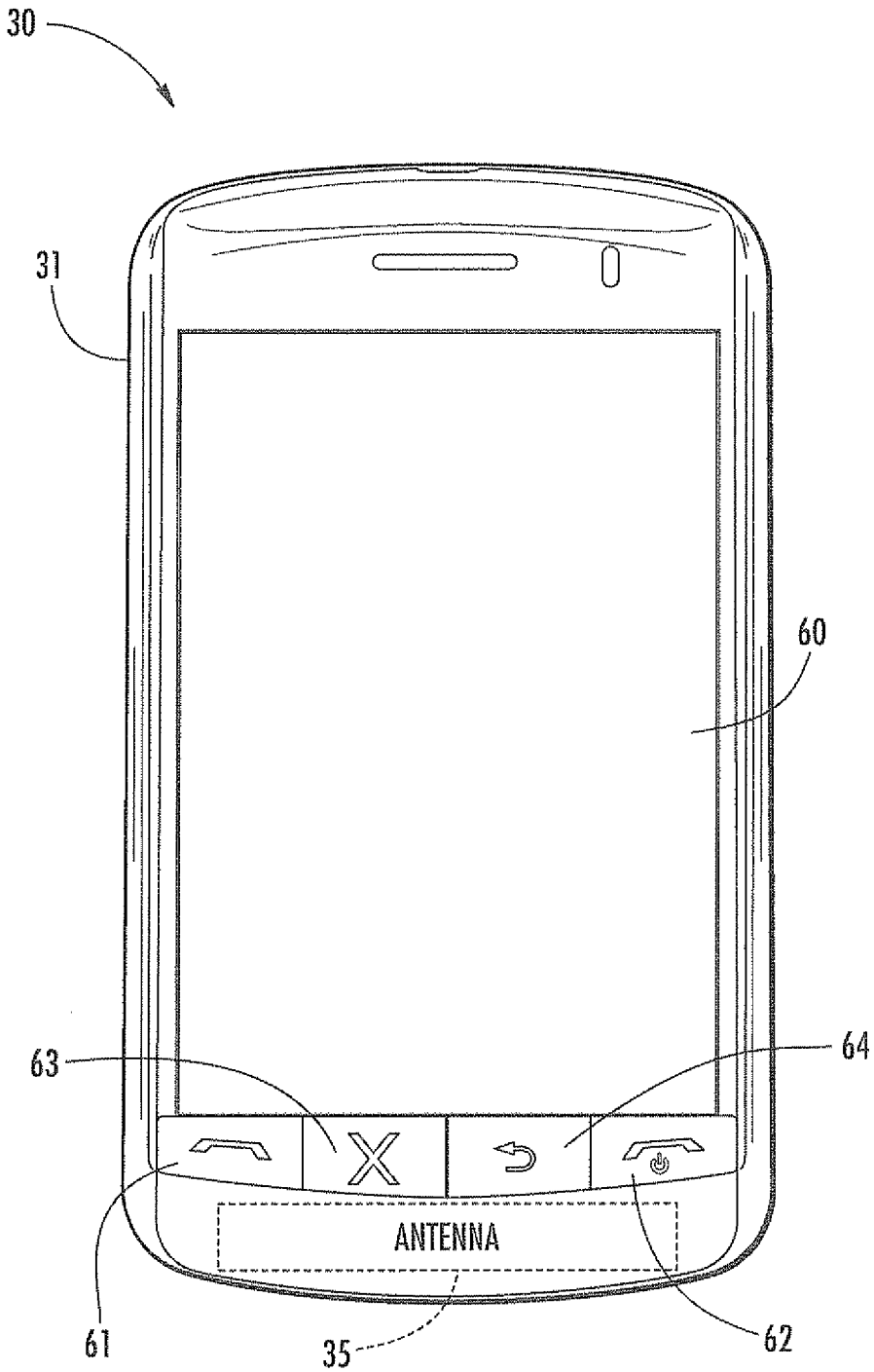
FIG. 1 is a front view of a mobile wireless communications device including an antenna in accordance with one exemplary aspect.

The present description is made with reference to the accompanying drawings, in which various embodiments are shown. However, many different embodiments may be used, and thus the description should not be construed as limited to the embodiments set forth herein. Rather, these embodiments are provided so that this disclosure will be thorough and complete. Like numbers refer to like elements throughout and prime notation is used to indicate similar elements in alternative embodiments.

In accordance with one exemplary aspect, a mobile wireless communications device may include a portable housing a printed circuit board (PCB) carried by the portable housing, and wireless transceiver circuitry carried by the PCB. The mobile wireless communications device also may include an antenna coupled to the wireless transceiver circuitry. The antenna may include a loop conductor, a first conductor body coupled to the loop conductor and extending into the interior thereof to define a first slotted opening with adjacent portions of the loop conductor, and a second conductor body coupled to the loop conductor and extending into the interior thereof to define a second slotted opening with adjacent portions of the loop conductor. The first and second conductive bodies may be spaced apart to define a third slotted opening therebetween. The first slotted opening may have an enlarged width portion adjacent the first conductive body. Accordingly, the antenna may provide increased multi-band and hearing aid compatibility (HAC) performance.

The loop conductor may have a gap therein between the first and second conductor bodies. The antenna may further include first and second conductor feed legs on respective opposing sides of the gap in the loop conductor. The first and second conductor feed legs may also position the loop conductor and the first and second conductor bodies in spaced relation above the PCB.

The loop conductor may have a rectangular shape, for example. The first and second conductor bodies also may have a rectangular shape. The antenna may further include a conductor arm extending outwardly from the loop conductor. The conductor arm may have a slotted opening therein. The first slotted opening may extend along the conductor arm, for example. The PCB may include a ground plane beneath the antenna.

A method aspect may be directed to a method of making a method making a mobile wireless communications device that may include a portable housing, a printed circuit board (PCB) carried by the portable housing, and wireless transceiver circuitry carried by the PCB. The method may include forming an antenna to be coupled to the wireless transceiver circuitry by at least forming a loop conductor and forming a first conductor body coupled to the loop conductor and extending into an interior thereof to define a first slotted opening with adjacent portions of the loop conductor. Forming the antenna may also be by forming a second conductor body coupled to the loop conductor and extending into the interior thereof to define a second slotted opening with adjacent portions of the loop conductor, for example. The first and second conductor bodies may be spaced apart to define a third slotted opening therebetween. The first slotted opening may have an enlarged width portion adjacent the first conductive body, for example.

Figure 2:
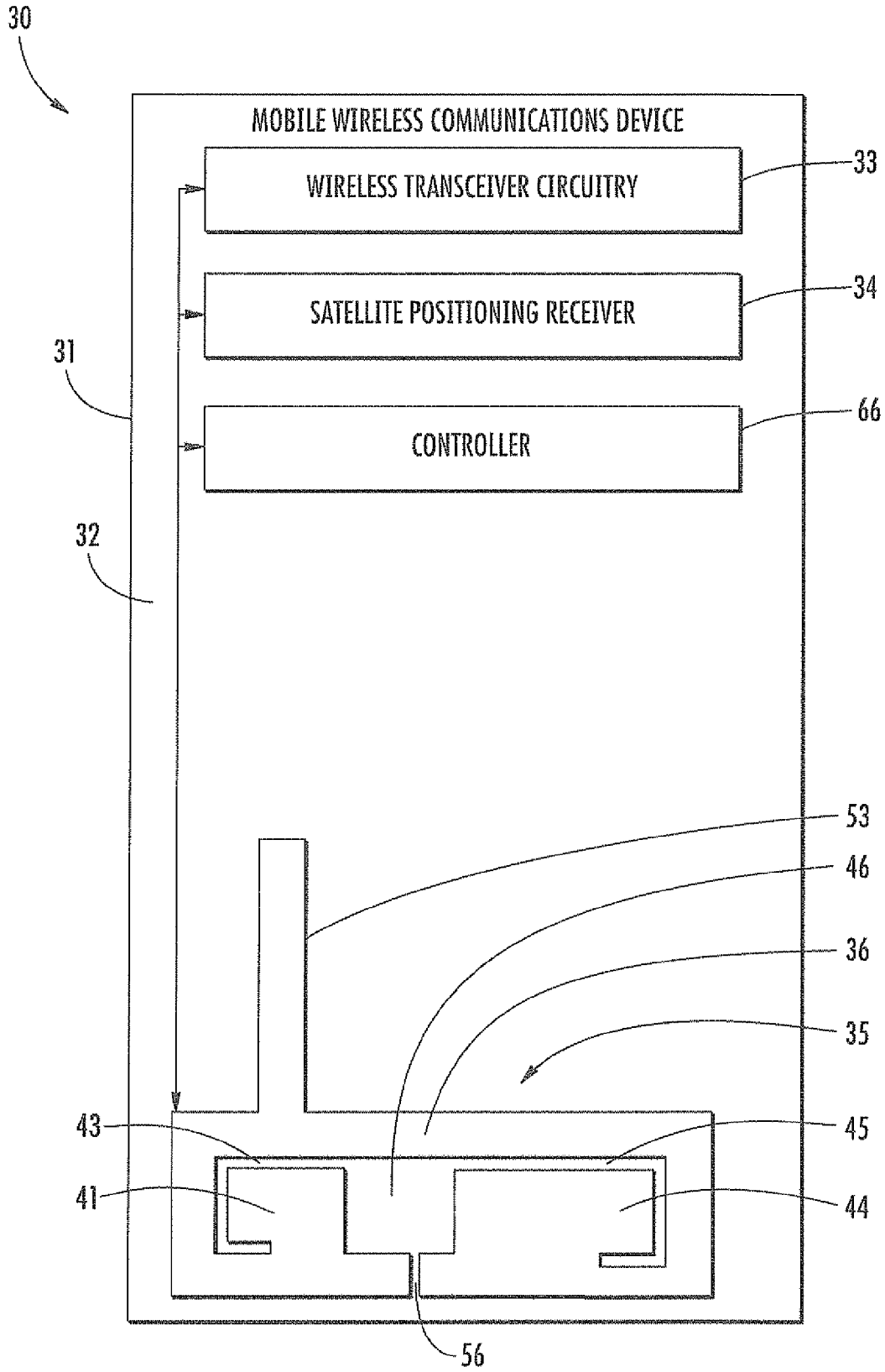
FIG. 2 is a schematic diagram of the printed circuit board (PCB) and the antenna of the device of FIG. 1.
Figure 3:
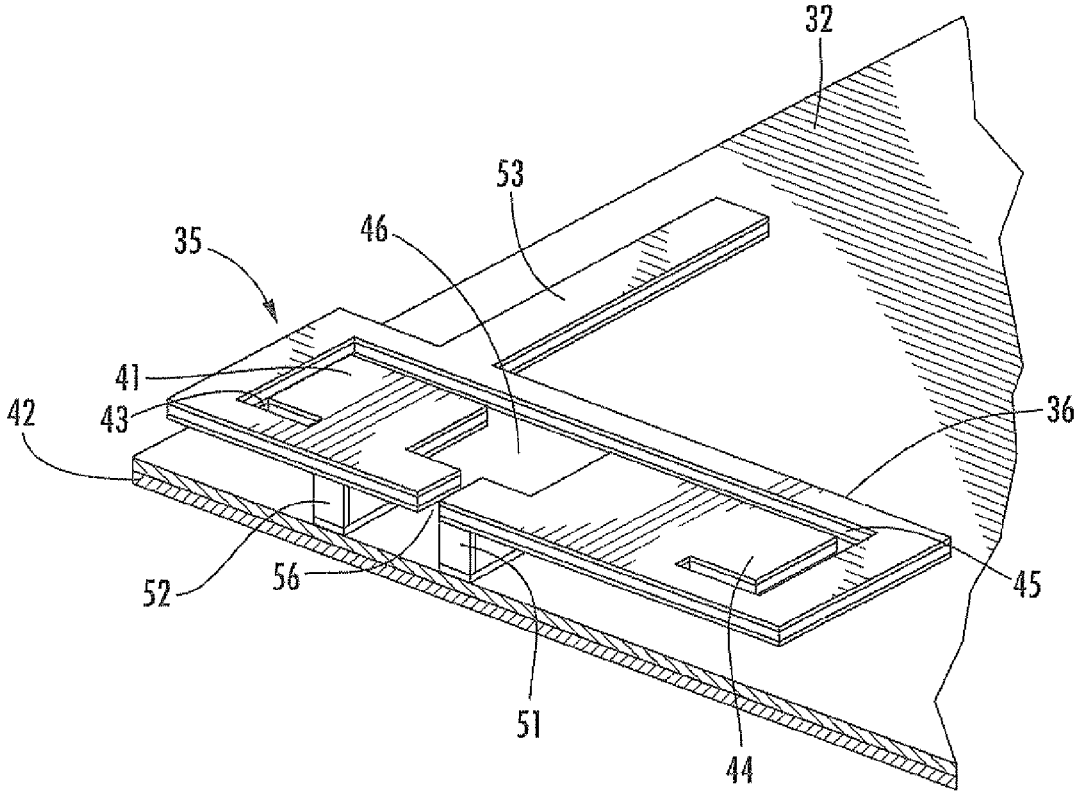
FIG. 3 is perspective view of the antenna and a portion of the PCB of FIG. 2.
Figure 4:
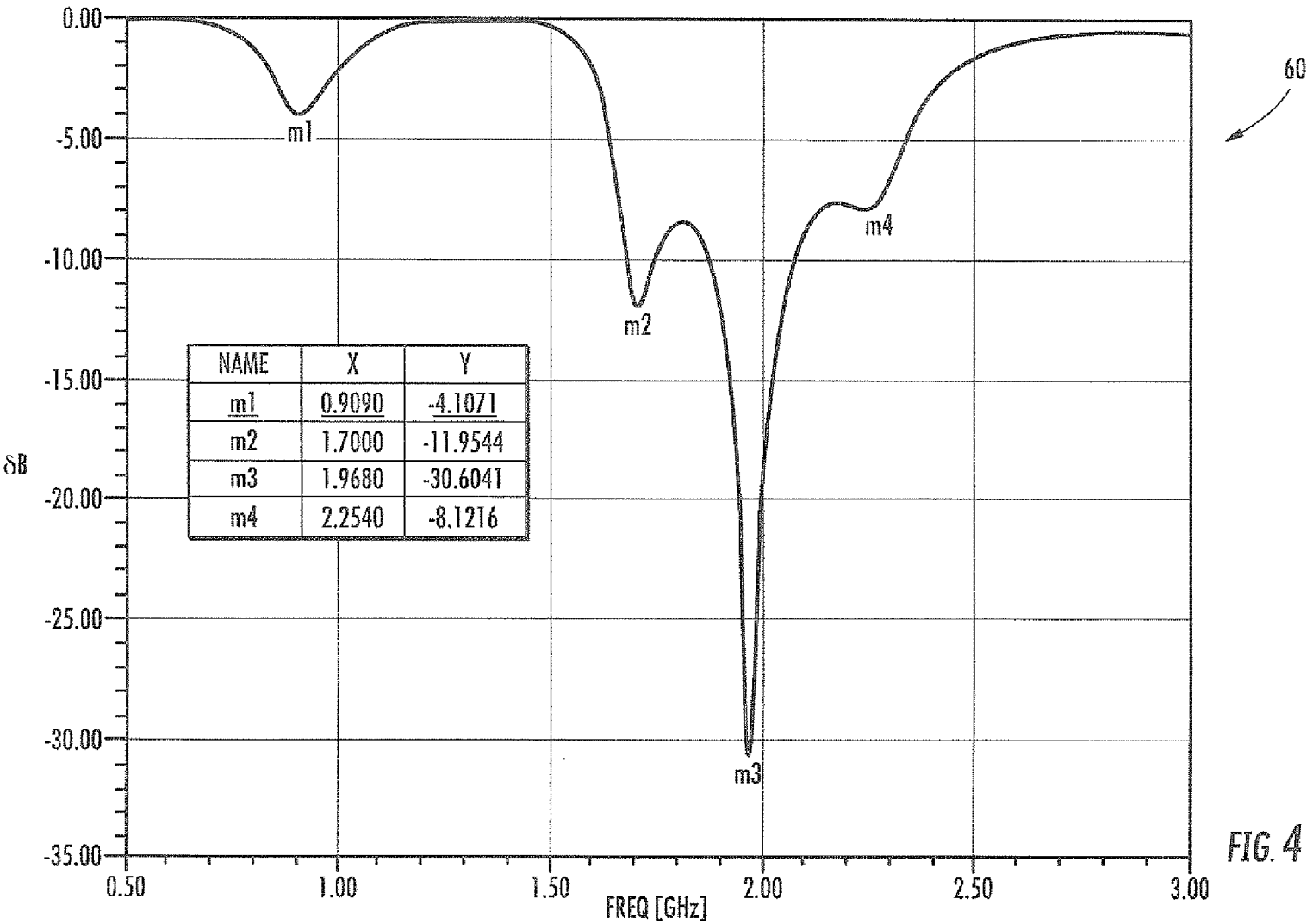
FIG. 4 is a return loss graph of the antenna of FIG. 2.

Referring initially to FIGS. 1-3 and the graph 60 of FIG. 4, a mobile wireless communications device 30 illustratively includes a portable housing 31, a printed circuit board (PCB) 32 carried by the portable housing, and wireless transceiver circuitry 33 carried by the portable housing. In some embodiments, not shown, the PCB 32 may be replaced by or used in conjunction with a metal chassis or other substrate. The PCB 32 also includes a conductive layer defining a ground plane 42.

A satellite positioning signal receiver 34 is also carried by the portable housing 31. The satellite positioning signal receiver 34 may be a Global Positioning System (GPS) satellite receiver, for example.

The exemplary device 30 further illustratively includes a display 60 and a plurality of control keys including an "off hook" (i.e., initiate phone call) key 61, an "on hook" (i.e., discontinue phone call) key 62, a menu key 63, and a return or escape key 64. Operation of the various device components and input keys, etc., will be described further below with reference to FIG. 12.

The device 30 further illustratively includes an antenna 35 coupled to the wireless transceiver circuitry 33. The antenna 35 includes a loop conductor 36 that defines an interior. The loop conductor 36 illustratively has a rectangular shape. The loop conductor 36 may be other shapes, as will be appreciated by those skilled in the art. The antenna 35 may be about two inches wide by one-half inch high, for example. The antenna 35 may be other dimensions.

The antenna 35 also includes a first conductor body 41. The first conductor body 41 is coupled to the loop conductor 36 and extends into the interior thereof to define a first slotted opening 43 with adjacent portions of the loop conductor. The first conductor body 41 also illustratively has a rectangular shape. The first conductor body 41 may be other shapes, to define the first slotted opening 43 to have different corresponding shapes.

More particularly, the size and shape of the first conductor body 41 advantageously defines the size and shape of the first slotted opening 43, which determines one of the operating frequency bands. In the illustrated embodiment, the first slotted opening 43 has a J-shape. Other shapes may be formed to change the perimeter length of the first slotted opening as will be appreciated by those skilled in the art. The first slotted opening 43 provides middle frequencies, for example, around 1900 MHz, in a relatively high band, for example, 1710 to 2170 MHz.

The antenna 35 also includes a second conductor body 44 coupled to the loop conductor 36 and extending into the interior thereof to define a second slotted opening 45 with adjacent portions of the loop conductor. The second conductor body 44 illustratively has a rectangular shape. The second conductor body 44 may be other shapes to define the second slotted opening 45 to have different shapes.

More particularly, the size and shape of the second conductor body 44 advantageously define the size and shape of the second slotted opening 45, which determine one of the operating frequency bands. The second slotted opening 45 has a J-shape. Other shapes may be used to change the perimeter length of the second slotted opening. The second slotted opening 45 advantageously provides a relatively high end, for example, near 2170 MHz, frequency response for the relatively high band, for example, 1710 to 2170 MHz.

The first and second conductive bodies 41, 44 are illustratively spaced apart to define a third slotted opening 46 therebetween. As will be appreciated by those skilled in the art, the function of each slot may be interchangeable depending on the form-factor. For example, the third slotted opening 46 may provide coupling between the first and second slotted openings 43, 45. The first, second and third slotted openings 43, 45, 46 advantageously provides increased bandwidth, for example, over a single slot antenna.

The loop conductor 36 illustratively has a gap 56 therein between the first and second conductor bodies 41, 44. The gap 56 advantageously tunes the impedance of the antenna 35.

The antenna 35 also includes a conductor arm 53 that extends outwardly from the loop conductor 36 and extends along the PCB 32. The conductor arm 53 advantageously lowers the resonant frequency for relatively low bands and may also improve hearing aid compliance (HAC) performance.

As will be appreciated by those skilled in the art, the overall operating frequency bands of the antenna 35 are determined by the length of the conductor arm 53, and the perimeter length of each of the first and second slotted openings 43, 45. The operating frequency bands of the antenna 35 are also determined by the length of the loop conductor 36 as will be appreciated by those skilled in the art.

The antenna 35, including the loop conductor 36, the first and second conductor bodies 41, 44 and the conductor 53 may define a planar antenna. However, in some embodiments, the antenna 35 may not be planar and may instead be curved to conform to a curved housing, for example.

The loop conductor 36 and the conductor arm 53, advantageously provide a frequency response for relatively low bands, for example, 825 to 960 MHz, and lower frequencies, for example, near 1710 MHz, of the relatively high band, for example, 1710 to 2170 MHz. As will be appreciated by those skilled in the art, Global System for mobile communications (GSM) communications may be at 824 to 960 MHz. The graph 60 of FIG. 4, illustrates a simulated return loss of the antenna 35 from 500 MHz to 3 GHz.

The antenna 35 also includes first and second feed legs 51, 52 on the respective opposing sides of the gap 56 in the loop conductor 36. The first feed leg 51 may define a feed point and be coupled to a respective antenna feed area on the PCB 32. The second feed leg 52 couples to the ground plane 42 or an antenna grounding area of the PCB 32.

The first and second feed legs 51, 52 also position the loop conductor 36 and the first and second conductor bodies 41, 44 above the PCB 32 in spaced relation therefrom. The distance between the antenna 35 and the PCB 32 help to determine the bandwidth of the antenna. In other words, without the antenna 35 being spaced above the PCB, for example, if the antenna were mounted directly to the PCB without the first and second feed legs 51, 52, the antenna would have reduced bandwidth. The first and second feed legs 51, 52 may be spring contacts, as will be appreciated by those skilled in the art.

A dielectric body (not shown) may be positioned between the antenna 35 and the PCB 32. The dielectric body may also be positioned above the antenna and may at least partially cover the antenna. The dielectric body advantageously may lower the operating frequency bands of the antenna 35, and thus may reduce the overall size of the antenna. Additionally, impedance matching components may be positioned between the antenna 35 and the PCB 32 to further reduce mismatch loss of the antenna.

The impedance of the antenna 35 is, at least in part, determined by the separation between the first and second feed legs 51, 52, or in other words, the feed and ground points. The distance or separation of the gap 56, and the width of the third slotted opening 46, also determine the impedance.

The operating frequency bands of the antenna 35 described herein may be particularly advantageous for cellular communications, for example, GSM and 3G bands. However, as will be appreciated by those skilled in the art, the antenna 35 may be configured to operate at GPS frequencies and cooperate with the satellite receiver 34. Additionally, the antenna 35 may also be configured to operate at wireless network frequencies, for example, WiFi. Of course, the antenna 35 may be configured to operate at other frequencies or frequency bands, either independently, or in combination.

The antenna 35 advantageously, provides increased bandwidth and radiated performance. Moreover, the antenna 35 may improve HAG and specific absorption rate (SAR) performance.

A controller 66 or processor may also be carried by the PCB 32. The controller 66 may cooperate with the other components, for example, the antenna 35, the satellite positioning signal receiver 34, and the wireless transceiver circuitry 33 to coordinate and control operations of the mobile wireless communications device 30. Operations may include mobile voice and data operations, including email and Internet data.

Figure 5:
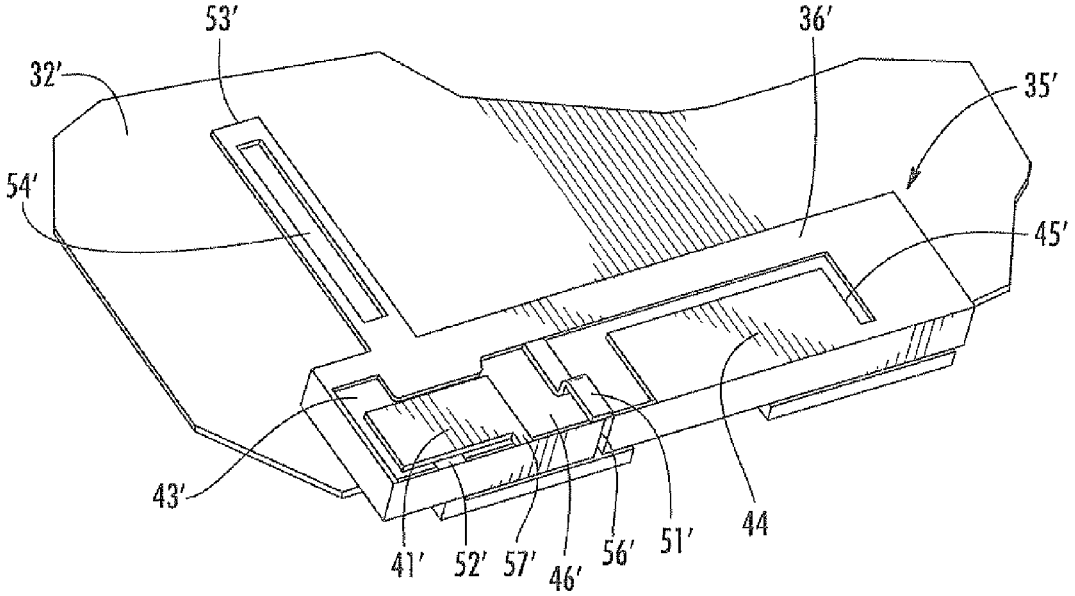
FIG. 5 is a perspective view of an antenna and a portion of a PCB in accordance with another exemplary aspect.

Referring now to FIG. 5, another embodiment of the antenna 35' is illustrated. The antenna 35' is non-planar. Illustratively, the first slotted opening 43' is widened toward the conductor arm 53' to increase the first slotted opening's perimeter length, and thus adjust the middle frequencies for the relatively high band. Additionally, while the first conductor body 41' has a rectangular shape, it is coupled to the loop conductor 36' by a small coupling portion 57'. The conductor arm 53' includes a slotted opening 54' therein.

Figure 6:
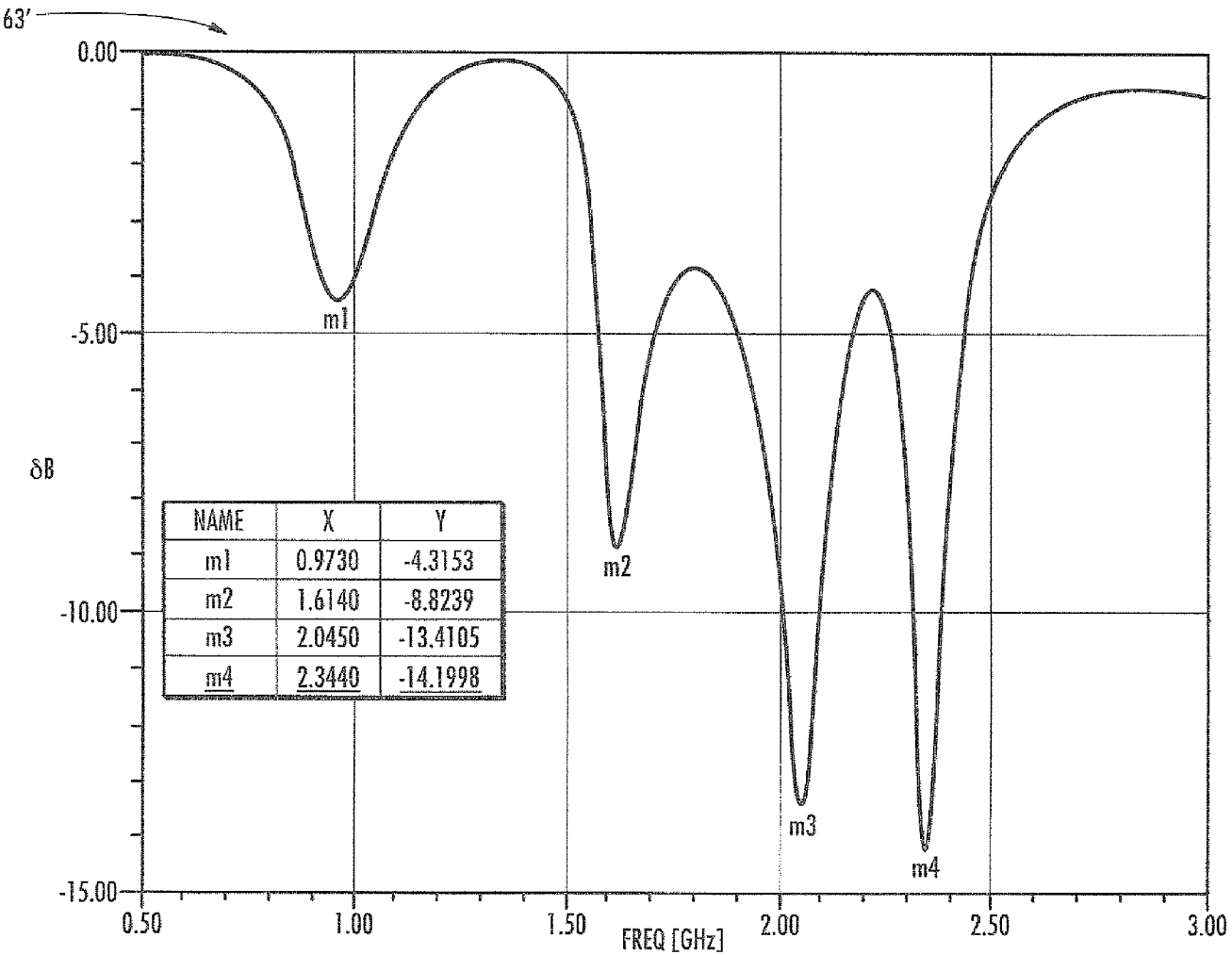
FIG. 6 is a return loss graph of the antenna of FIG. 5.
Figure 7:
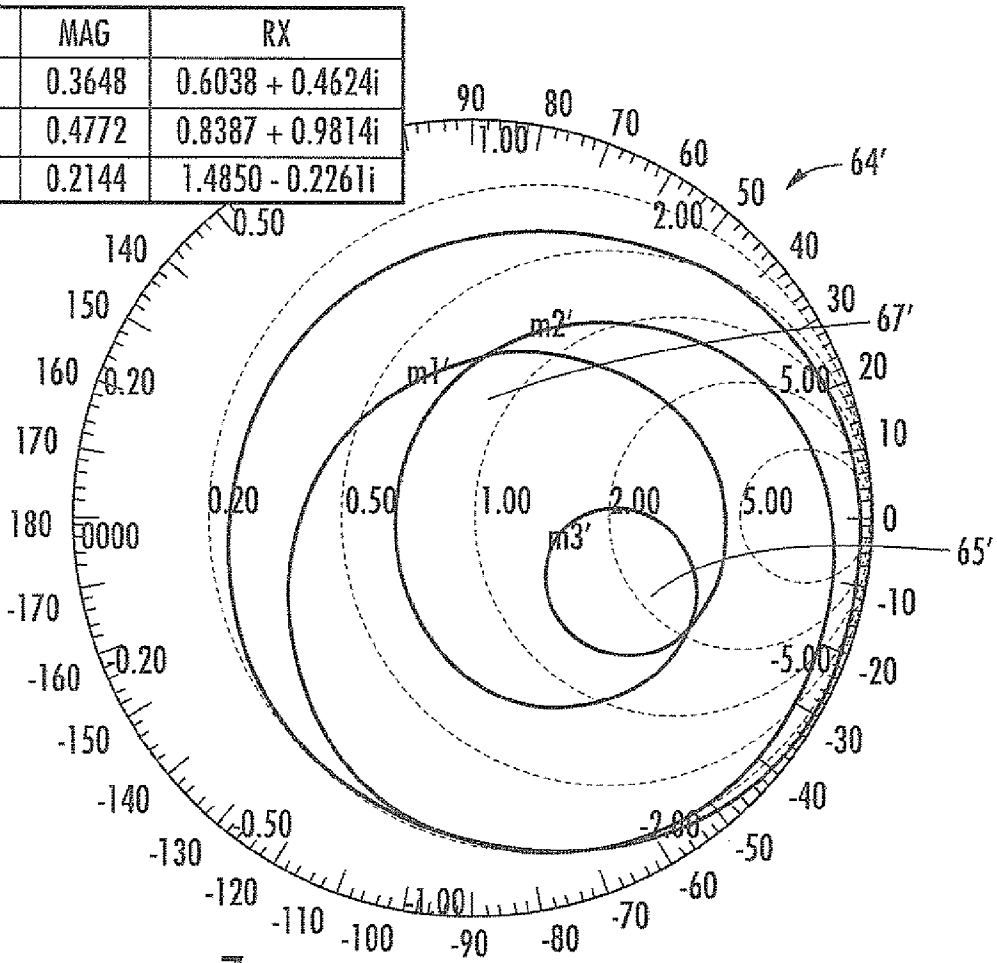
FIG. 7 is a Smith chart of impedance of the antenna of FIG. 5.

Referring additionally to the graphs 63', 64' in FIGS. 6 and 7, the simulated return loss and impedance of the antenna 35' without the optional slotted opening 54' are respectively illustrated. Illustratively, three distinctive frequency bands are obtained from the antenna 35'. These three frequencies combine to provide a relatively wide bandwidth in the relatively high band for the antenna 35'.

Referring more particularly to the Smith chart 67' (FIG. 7), the two highest and lowest frequency bands form a loop 67' around the 50 Ohm point, while the center frequency band forms a smaller loop 65' inside the bigger loop 67'. First and second markers m1', m2' are placed on both sides of the crossing point of the bigger loop 67'. These markers m1', m2' make the lowest and highest limit of the broadband response of the constant voltage standing wave ratio (VSWR) loop. Thus, tuning may target 1.71 GHz and 2.17 GHz for the first and second markers m1', m2'.

Figure 8:
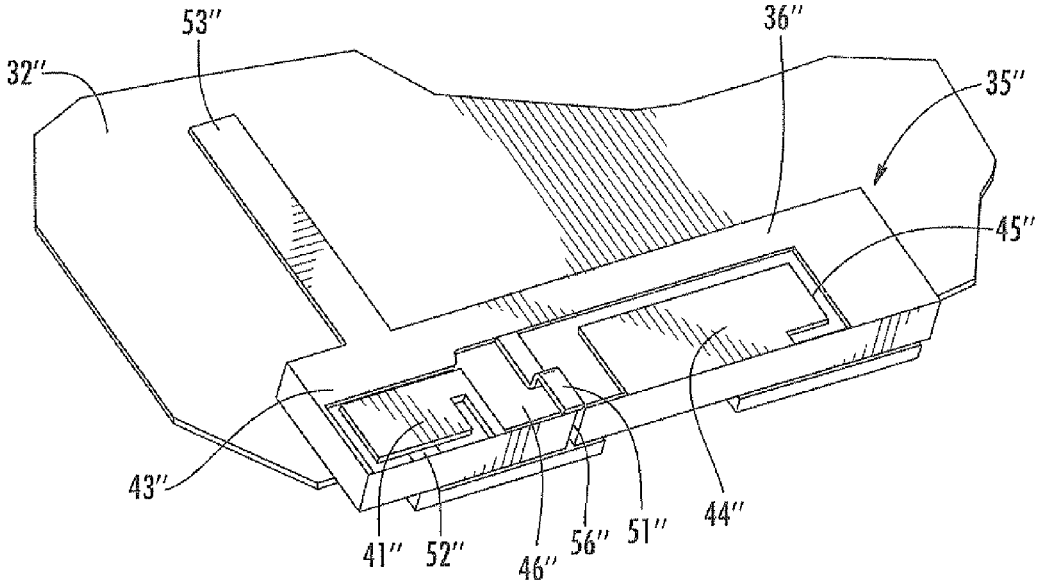
FIG. 8 is a perspective view of an antenna and a portion of a PCB in accordance with another exemplary aspect.

Referring now to FIG. 8, another embodiment of the antenna 35" illustratively includes a first slotted opening 43" that extends in four directions to increase the perimeter length thereof. While the second conductive body 44" illustratively has a generally rectangular shape, it is coupled to the loop conductor 36" by a portion cutaway to define the second slotted opening 45" to be a J-shape.

Figure 9:
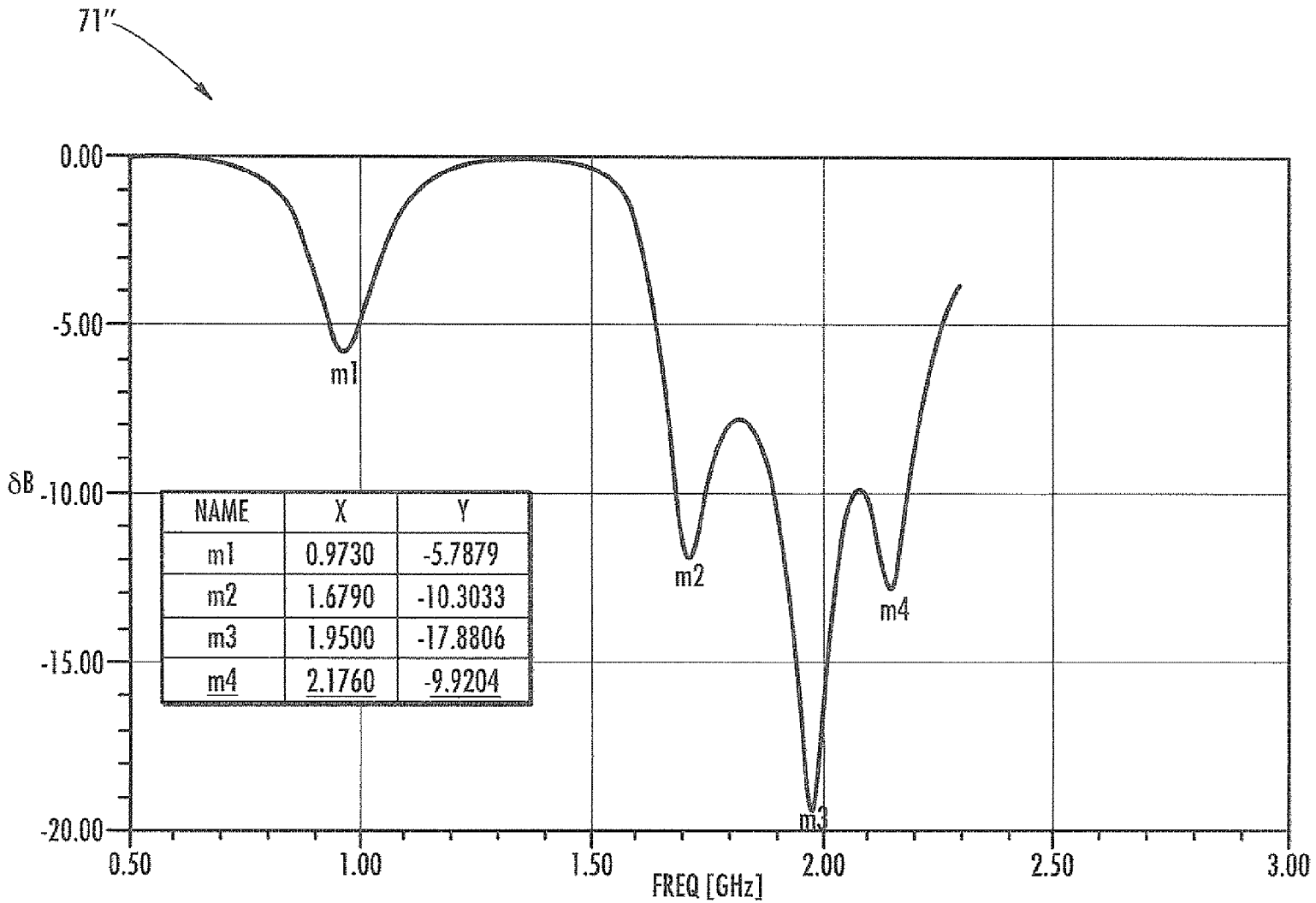
FIG. 9 is a return loss graph of the antenna of FIG. 8.
Figure 10:
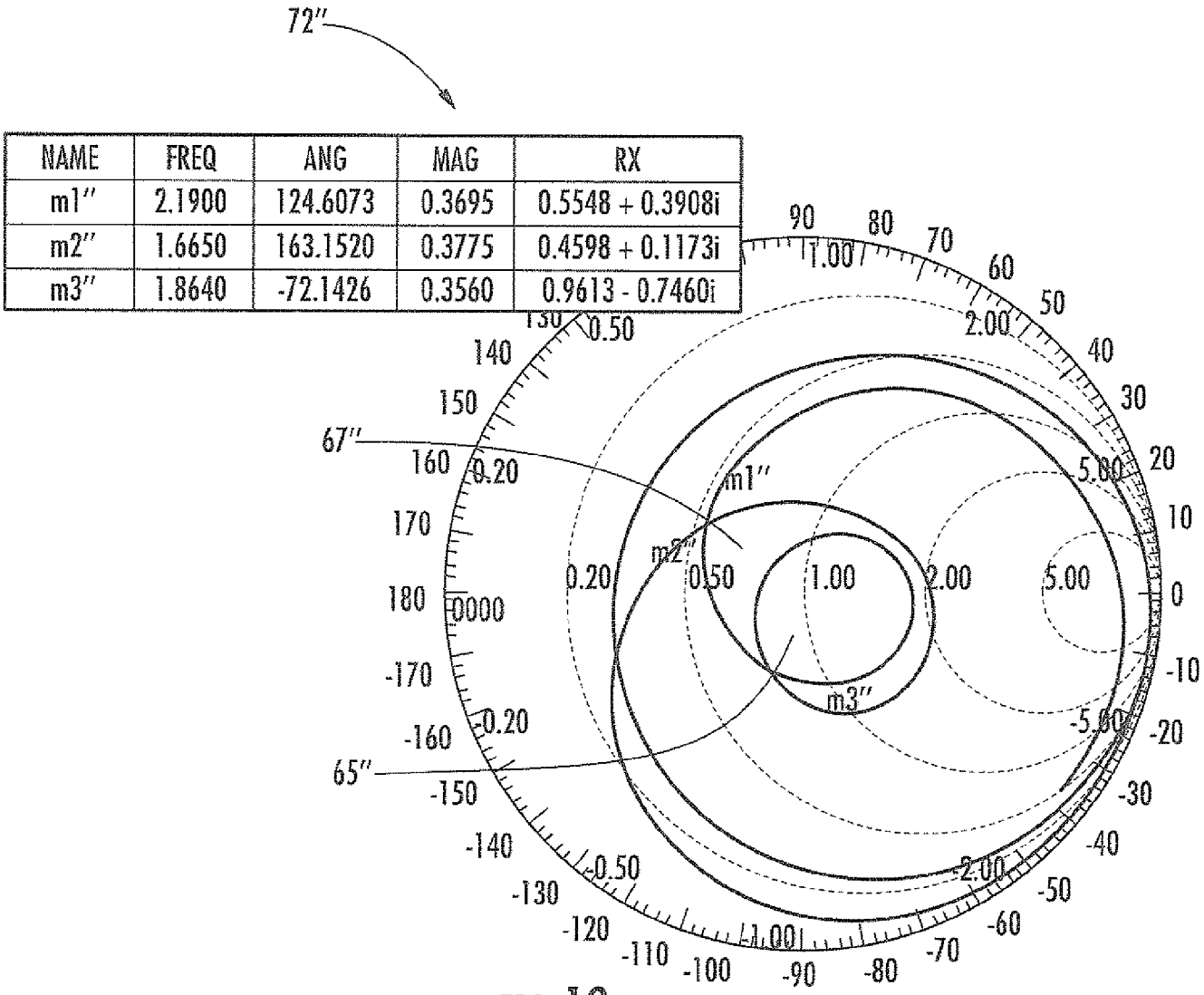
FIG. 10 is a Smith chart of impedance of the antenna of FIG. 8.

Referring additionally to the graphs 71", 72" in FIGS. 9 and 10, the simulated return loss and impedance of the antenna 35" are respectively illustrated. Referring more particularly to the graph or Smith chart 72" in FIG. 10, the loop is kept relatively small and the two loops 65", 67" wrap around each other. The return loss of the antenna 35" in the graph 71" in FIG. 9 illustrates the resulting broadband response.

Figure 11:
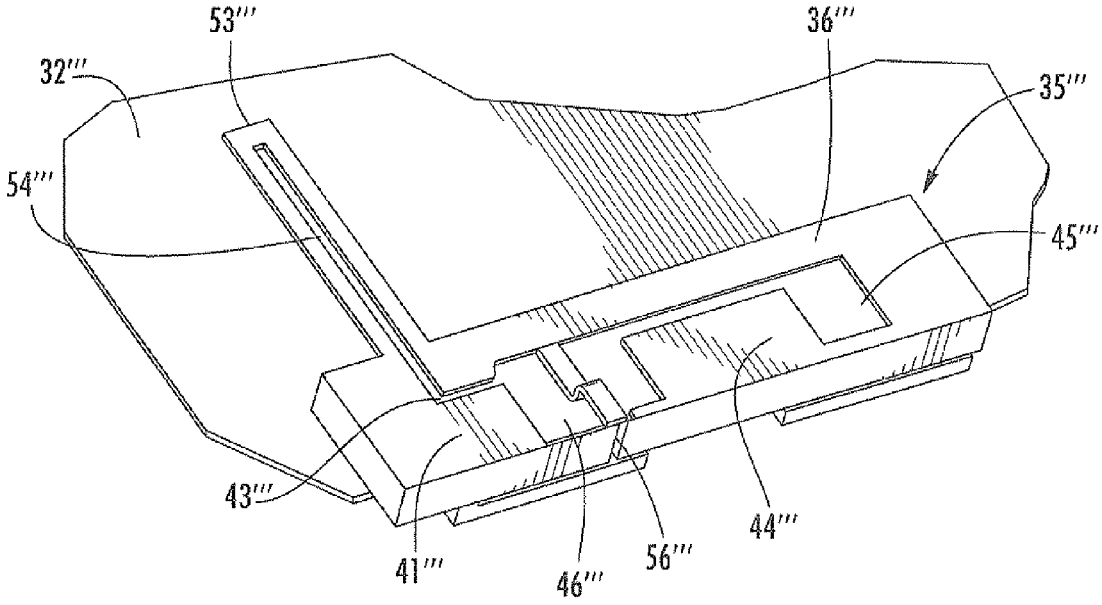
FIG. 11 is a perspective view of an antenna and a portion of a PCB in accordance with another exemplary aspect.

Referring now to FIG. 11, another embodiment of the antenna 35''' is illustrated. The antenna 35''' is non-planar. Illustratively, the first slotted opening 43''' is relatively narrow and extends toward the conductor arm 53'''. The first slotted opening 43''' extends outwardly along the conductor arm 53''' so that the slotted opening 54''' of the conductor arm is an extension of the first slotted opening. The second slotted opening 45''' is initially relatively narrow and extends into a widened area portion.

Figure 12:
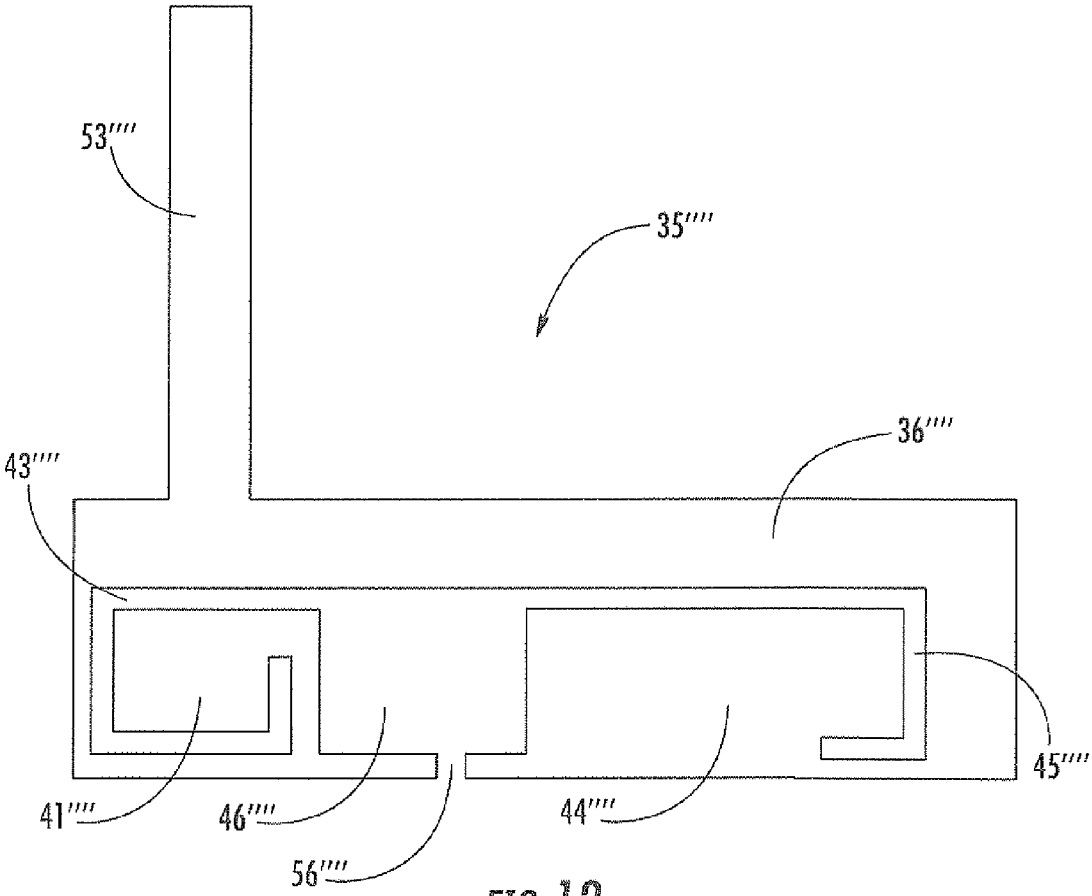
FIG. 12 is a schematic diagram of an antenna in accordance with another exemplary aspect.
Figure 13A:
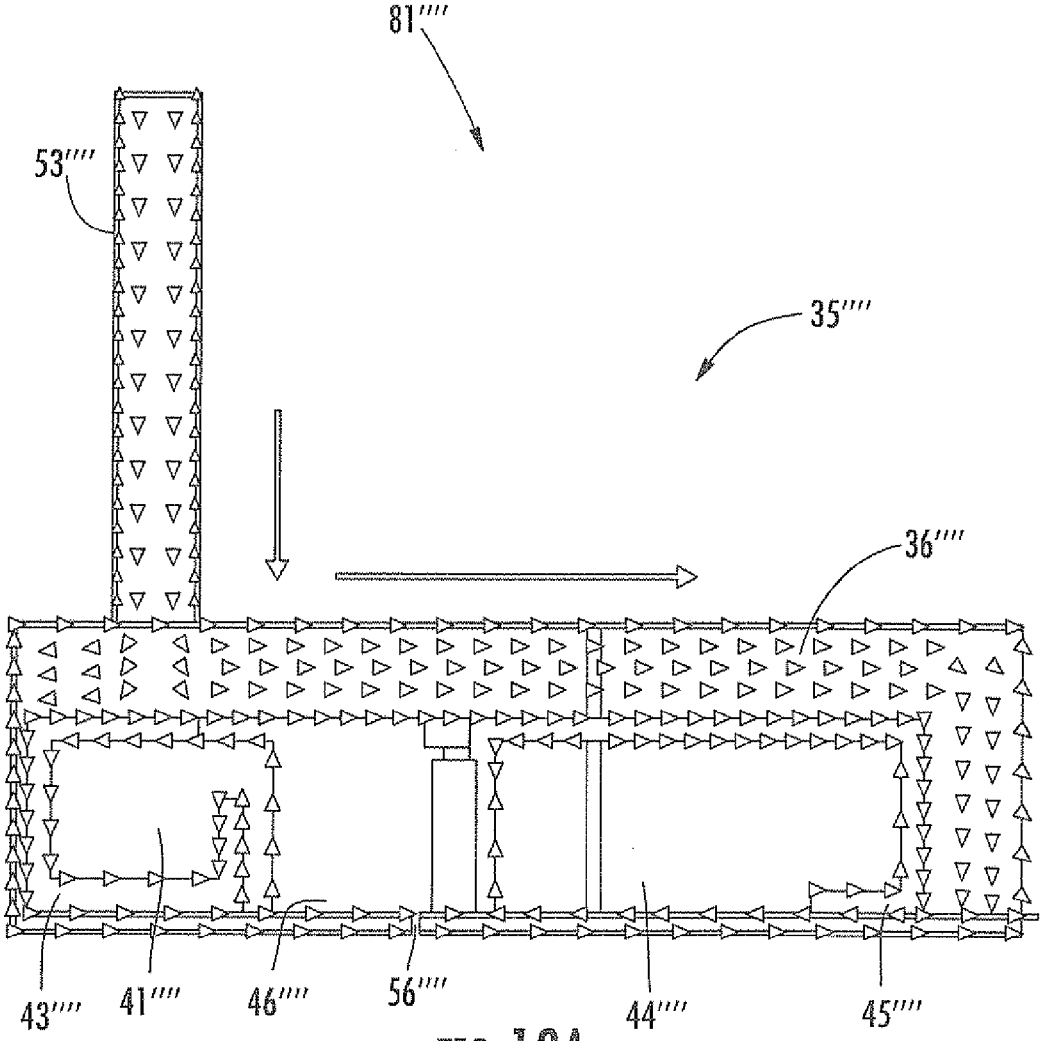
FIGS. 13*a*-13*c* are currents maps of the antenna of FIG. 12.
Figure 13B:
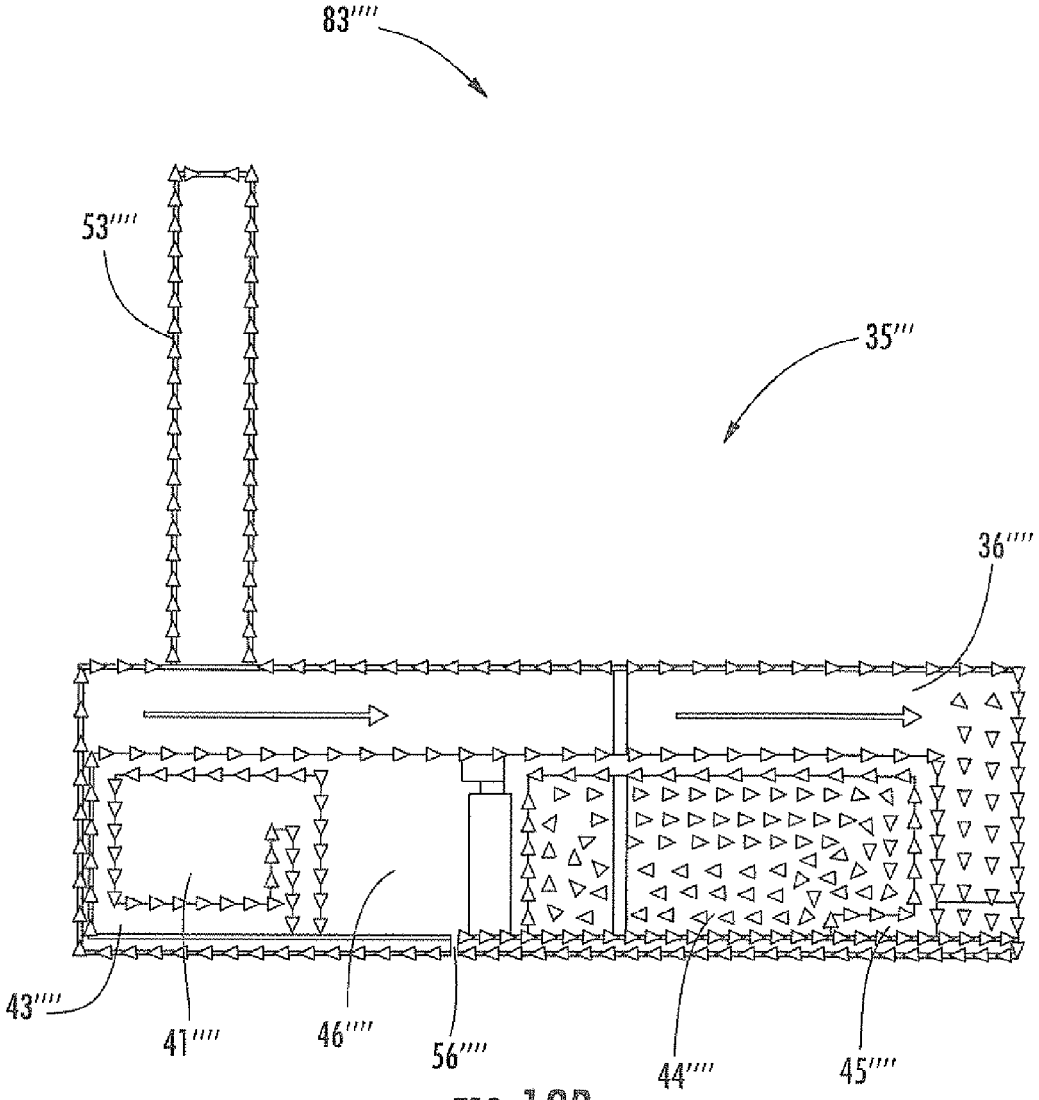
Figure 13C:
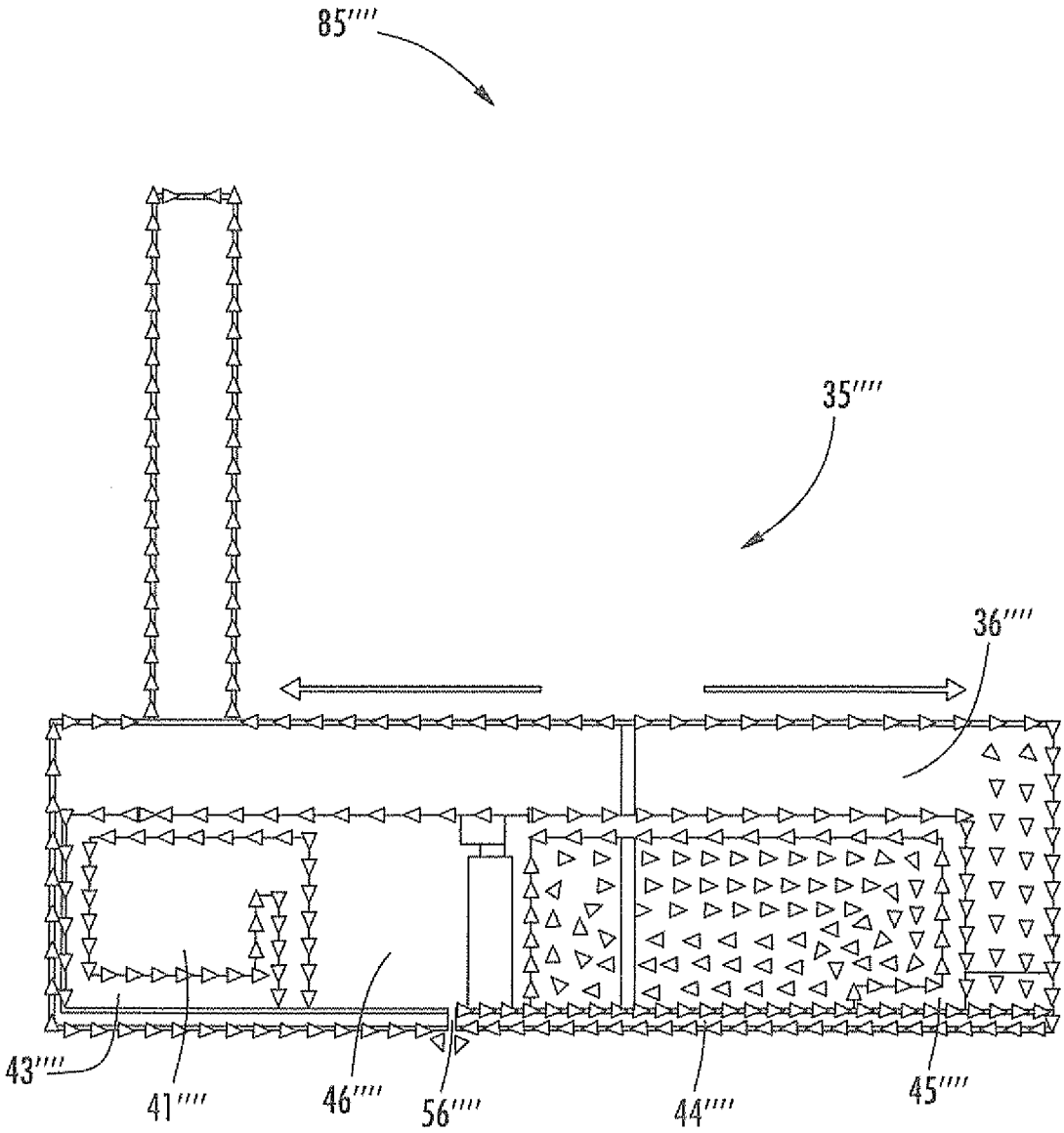

Referring now to FIG. 12, and the graphs of FIGS. 13*a-c*, operation of the antenna 35'''' is described with respect to current maps, 81'''', 83'''', 85'''', respectively. As will be appreciated by those skilled in the art, the antenna 35'''' operates with three distinctive resonant frequency bands, which may be combined to provide a relatively wide frequency response. A first mode of operation provides a frequency band that is in the low end of the relatively high frequency band, for example, at frequencies near m2 in the graph 63' of FIG. 6. In the first mode of operation, antenna 35'''' operation is provided by the conductive arm 53'''' and the long edge of the loop conductor 36''''. The graph 81'''' in FIG. 13*a* illustrates a current distribution that is in-phase along the conductive arm 53'''' and along the width of the loop conductor 36''''. The cooperation of the conductive arm 53'''' and the long edge advantageously operate like an L-shaped dipole.

A second mode of operation provides middle frequencies of the relatively high frequency band, for example, at frequencies near m3 in the graph 63' of FIG. 6. The graph 83'''' in FIG. 13*b* illustrates the current distribution being relatively strong along the perimeter of the loop conductor 36''''. Moreover, the current on each of the left and right sides of the loop conductor 36'''' flows in the same direction.

A third mode of operation provides relatively high frequencies of the relatively high frequency band, for example, at frequencies near m3 in the graph 63' of FIG. 6. The graph 85'''' in FIG. 13*c* illustrates the current along the first and second slotted openings 43'''', 45'''' flowing in different directions. The currents on each side of the antenna 35'''' is 180 degrees out of phase. As will be appreciated by those skilled in the art, the relative phase difference of 180 degrees is accomplished by making the third slotted opening 46'''' relatively large, for example, as compared to other embodiments.

Figure 14:
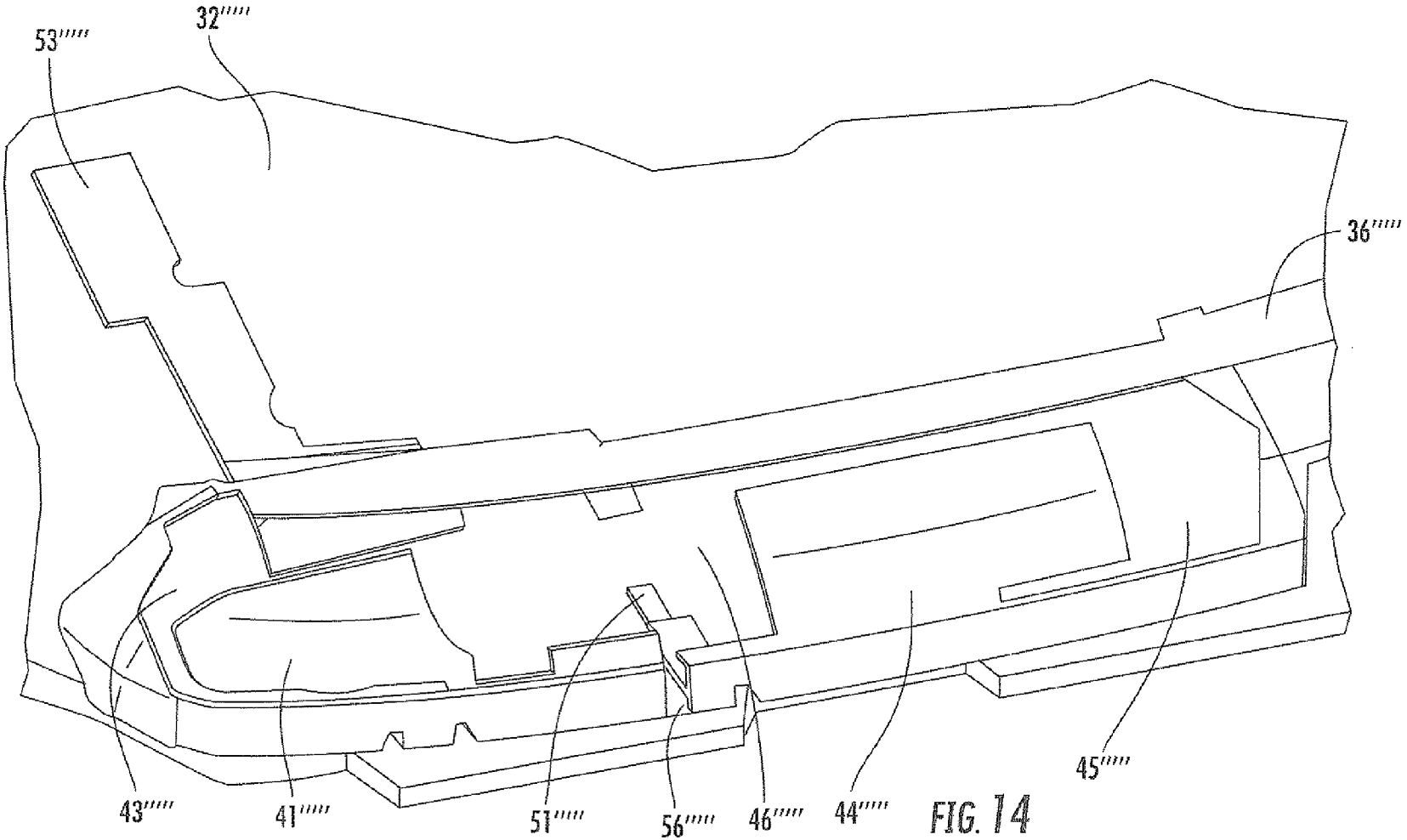
FIG. 14 is an antenna and a portion of a PCB in accordance with another exemplary aspect.

Referring now to FIG. 14, another embodiment of the antenna 35'''' is illustratively curved around an end of the PCB 32'''''. The curved shape of the antenna 35'''' may advantageously allow improved fitment within the housing 31'''' of the mobile wireless communications device 30''''.

Figure 15:
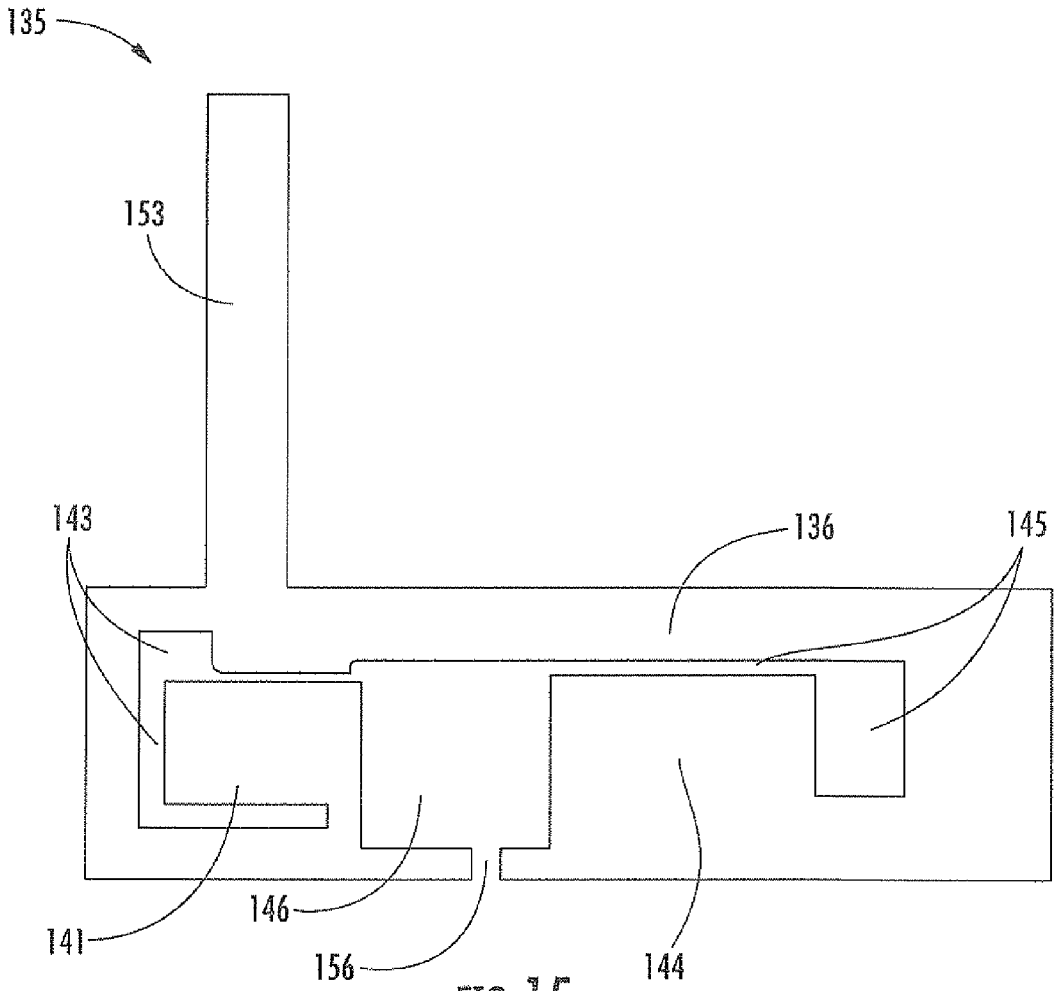
FIG. 15 is a schematic diagram of yet another antenna in accordance with another exemplary aspect.

Referring now to FIG. 15, as will be appreciated by those skilled in the art, different elements may be selectively combined from the embodiments described herein or combined with additional elements to form different width and shape slotted openings. Illustratively, the antenna 135 includes a first slotted opening 143 that includes an extended width portion adjacent the conductor arm 153, similar to the embodiment illustrated in FIG. 5. The second slotted opening 145 is illustratively relatively narrow adjacent the third slotted opening 146 and extends into an enlarged area, or width, slotted opening. As will be appreciated by those skilled in the art, adjusting the size and shape of the conductor bodies 141, 144, and thus the slotted openings 143, 146, 145 allows antenna performance to be adjusted for increased performance operation at different frequency bands.

Figure 16:
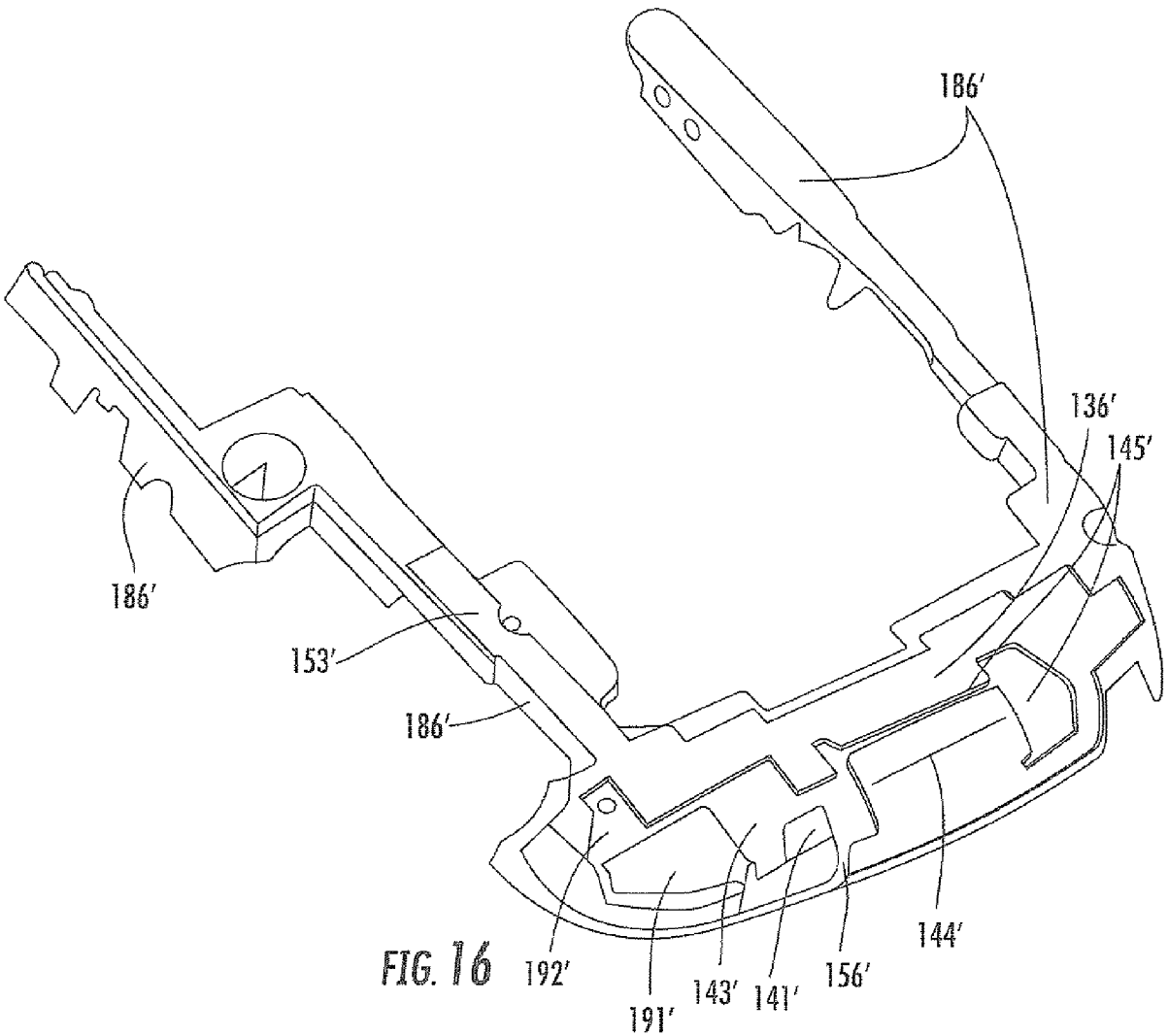
FIG. 16 is an antenna and a support frame in accordance with another exemplary aspect.

Referring now to FIG. 16, another embodiment of the antenna 135' is illustratively curved around an end of and supported by a support frame 186'. The support frame 186' may be coupled to the PCB 132' and carried by the housing 131'. The antenna 135' illustratively includes a third conductor body 191' coupled to the loop conductor 136' and spaced apart from the first conductor body 141' to define a fourth slotted opening 192' therebetween.

A method aspect is directed to a method of making a method making a mobile wireless communications device that includes a portable housing 31, a printed circuit board 32 (PCB) carried by the portable housing, and wireless transceiver circuitry 33 carried by the PCB. The method may include forming an antenna 135 to be coupled to the wireless transceiver circuitry 33 by at least forming a loop conductor 136 and forming a first conductor body 141 coupled to the loop conductor and extending into an interior thereof to define a first slotted opening 143 with adjacent portions of the loop conductor. The antenna 135 is also formed by forming a second conductor body 144 coupled to the loop conductor 136 and extending into the interior thereof to define a second slotted opening 145 with adjacent portions of the loop conductor, for example. The first and second conductor bodies 141, 144 may be spaced apart to define a third slotted opening 146 therebetween. The first slotted opening 143 may have an enlarged width portion adjacent the first conductive body, for example.

Exemplary components that may be used in various embodiments of the above-described mobile wireless communications device are now described with reference to an exemplary mobile wireless communications device 1000 shown in FIG. 17. The device 1000 illustratively includes a housing 1200, a keypad 1400 and an output device 1600. The output device shown is a display 1600, which may comprise a full graphic LCD. In some embodiments, display 1600 may comprise a touch-sensitive input and output device. Other types of output devices may alternatively be utilized. A processing device 1800 is contained within the housing 1200 and is coupled between the keypad 1400 and the display 1600. The processing device 1800 controls the operation of the display 1600, as well as the overall operation of the mobile device 1000, in response to actuation of keys on the keypad 1400 by the user. In some embodiments, keypad 1400 may comprise a physical keypad or a virtual keypad (e.g., using a touch-sensitive interface) or both.

The housing 1200 may be elongated vertically, or may take on other sizes and shapes (including clamshell housing structures, for example). The keypad 1400 may include a mode selection key, or other hardware or software for switching between text entry and telephony entry.

Figure 17:
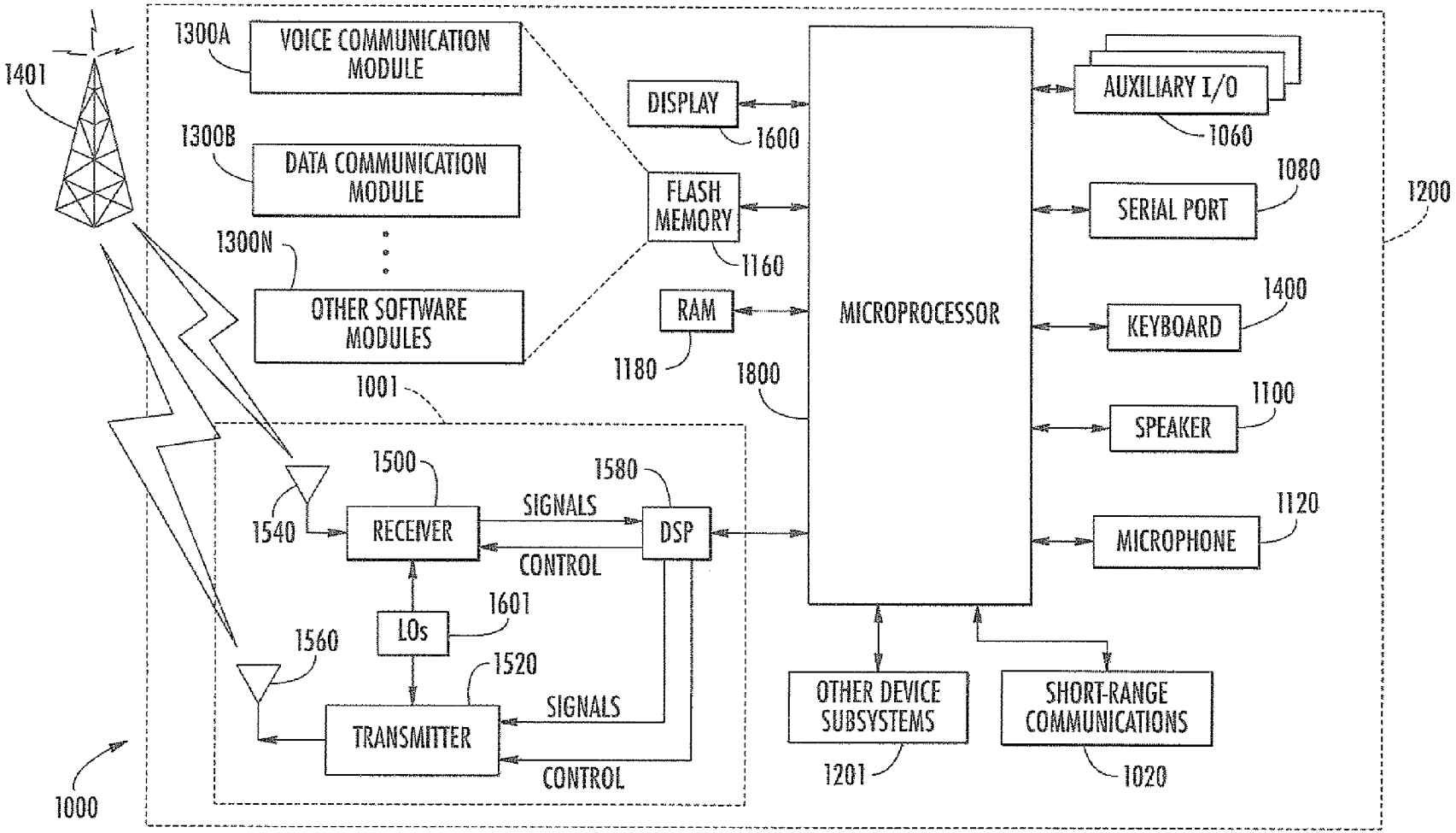
FIG. 17 is a schematic block diagram illustrating additional components that may be included in the mobile wireless communications device of FIG. 1.

In addition to the processing device 1800, other parts of the mobile device 1000 are shown schematically in FIG. 17. These include a communications subsystem 1001; a short-range communications subsystem 1020; the keypad 1400 and the display 1600, along with other input/output devices 1060, 1080, 1100 and 1120; as well as memory devices 1160, 1180 and various other device subsystems 1201. The mobile device 1000 may comprise a two-way RF communications device having voice and data communications capabilities. In addition, the mobile device 1000 may have the capability to communicate with other computer systems via the Internet.

Operating system software executed by the processing device 1800 may be stored in a persistent store, such as the flash memory 1160, but may be stored in other types of memory devices, such as a read only memory (ROM) or similar storage element. In addition, system software, specific device applications, or parts thereof, may be temporarily loaded into a volatile store, such as the random access memory (RAM) 1180. Communications signals received by the mobile device may also be stored in the RAM 1180.

The processing device 1800, in addition to its operating system functions, enables execution of software applications or modules 1300A-1300N on the device 1000, such as software modules for performing various steps or operations. A predetermined set of applications that control basic device operations, such as data and voice communications 1300A and 1300B, may be installed on the device 1000 during manufacture. In addition, a personal information manager (PIM) application may be installed during manufacture. The PIM may be capable of organizing and managing data items, such as e-mail, calendar events, voice mails, appointments, and task items. The PIM application may also be capable of sending and receiving data items via a wireless network 1401. The PIM data items may be seamlessly integrated, synchronized and updated via the wireless network 1401 with the device user's corresponding data items stored or associated with a host computer system.

Communication functions, including data and voice communications, are performed through the communications subsystem 1001, and possibly through the short-range communications subsystem. The communications subsystem 1001 includes a receiver 1500, a transmitter 1520, and one or more antennas 1540 and 1560. In addition, the communications subsystem 1001 also includes a processing module, such as a digital signal processor (DSP) 1580, and local oscillators (LOs) 1601. The specific design and implementation of the communications subsystem 1001 is dependent upon the communications network in which the mobile device 1000 is intended to operate. For example, a mobile device 1000 may include a communications subsystem 1001 designed to operate with the Mobitex™, Data TAC™ or General Packet Radio Service (GPRS) mobile data communications networks, and also designed to operate with any of a variety of voice communications networks, such as AMPS, TDMA, CDMA, WCDMA, PCS, GSM, EDGE, etc. Other types of data and voice networks, both separate and integrated, may also be utilized with the mobile device 1000. The mobile device 1000 may also be compliant with other communications standards such as GSM, 3G, UMTS, 4G, etc.

Network access requirements vary depending upon the type of communication system. For example, in the Mobitex and DataTAC networks, mobile devices are registered on the network using a unique personal identification number or PIN associated with each device. In GPRS networks, however, network access is associated with a subscriber or user of a device. A GPRS device therefore utilizes a subscriber identity module, commonly referred to as a SIM card, in order to operate on a GPRS network.

When required network registration or activation procedures have been completed, the mobile device 1000 may send and receive communications signals over the communication network 1401. Signals received from the communications network 1401 by the antenna 1540 are routed to the receiver 1500, which provides for signal amplification, frequency down conversion, filtering, channel selection, etc., and may also provide analog to digital conversion. Analog-to-digital conversion of the received signal allows the DSP 1580 to perform more complex communications functions, such as demodulation and decoding. In a similar manner, signals to be transmitted to the network 1401 are processed (e.g. modulated and encoded) by the DSP 1580 and are then provided to the transmitter 1520 for digital to analog conversion, frequency up conversion, filtering, amplification and transmission to the communication network 1401 (or networks) via the antenna 1560.

In addition to processing communications signals, the DSP 1580 provides for control of the receiver 1500 and the transmitter 1520. For example, gains applied to communications signals in the receiver 1500 and transmitter 1520 may be adaptively controlled through automatic gain control algorithms implemented in the DSP 1580.

In a data communications mode, a received signal, such as a text message or web page download, is processed by the communications subsystem 1001 and is input to the processing device 1800. The received signal is then further processed by the processing device 1800 for an output to the display 1600, or alternatively to some other auxiliary I/O device 1060. A device user may also compose data items, such as e-mail messages, using the keypad 1400 and/or some other auxiliary I/O device 1060, such as a touchpad, a rocker switch, a thumb-wheel, or some other type of input device. The composed data items may then be transmitted over the communications network 1401 via the communications subsystem 1001.

In a voice communications mode, overall operation of the device is substantially similar to the data communications mode, except that received signals are output to a speaker 1100, and signals for transmission are generated by a microphone 1120. Alternative voice or audio I/O subsystems, such as a voice message recording subsystem, may also be implemented on the device 1000. In addition, the display 1600 may also be utilized in voice communications mode, for example to display the identity of a calling party, the duration of a voice call, or other voice call related information.

The short-range communications subsystem enables communication between the mobile device 1000 and other proximate systems or devices, which need not necessarily be similar devices. For example, the short-range communications subsystem may include an infrared device and associated circuits and components, or a Bluetooth™ communications module to provide for communication with similarly-enabled systems and devices.

Further details of multi-band loop antennas may be found in co-pending application 38949-US-PAT, which is assigned to the assignee of the present application, and the entire contents of all of which are herein incorporated by reference. Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that modifications and embodiments are intended to be included.

That which is claimed is:

1. A mobile wireless communications device comprising:
a portable housing;
a printed circuit board (PCB) carried by said portable housing;
wireless transceiver circuitry carried by said PCB; and
an antenna coupled to said wireless transceiver circuitry and comprising
a loop conductor,
a first conductor body coupled to said loop conductor and extending into an interior thereof to define a first slotted opening with adjacent portions of said loop conductor, and
a second conductor body coupled to said loop conductor and extending into the interior thereof to define a second slotted opening with adjacent portions of said loop conductor,
said first and second conductor bodies being spaced apart to define a third slotted opening therebetween,
the first slotted opening having an enlarged width portion adjacent said first conductive body,
said loop conductor having a gap therein between said first and second conductor bodies.

2. The mobile wireless communications device according to claim 1, wherein said antenna further comprises first and second conductor feed legs on respective opposing sides of the gap in said loop conductor.

3. The mobile wireless communications device according to claim 2, wherein said first and second conductor feed legs also position said loop conductor and first and second conductor bodies in spaced relation above said PCB.

4. The mobile wireless communications device according to claim 1, wherein each of said first and second conductor bodies has a rectangular shape.

5. The mobile wireless communications device according to claim 1, wherein said antenna further comprises a conductor arm extending outwardly from said loop conductor.

6. The mobile wireless communications device according to claim 5, wherein said conductor arm has a slotted opening therein.

7. The mobile wireless communications device according to claim 5, wherein said first slotted opening extends along said conductor arm.

8. The mobile wireless communications device according to claim 1, wherein said PCB comprises a ground plane beneath said antenna.

9. A mobile wireless communications device comprising:
a portable housing;
a printed circuit board (PCB) carried by said portable housing;
wireless transceiver circuitry carried by said PCB; and
an antenna coupled to said wireless transceiver circuitry and comprising
a loop conductor having a rectangular shape,
a first conductor body coupled to said loop conductor and extending into an interior thereof to define a first slotted opening with adjacent portions of said loop conductor, and
a second conductor body coupled to said loop conductor and extending into the interior thereof to define a second slotted opening with adjacent portions of said loop conductor,
said first and second conductor bodies being spaced apart to define a third slotted opening therebetween,
the first slotted opening having an enlarged width portion adjacent said first conductive body,
said loop conductor having a gap therein between said first and second conductor bodies.

10. The mobile wireless communications device according to claim 9, wherein said antenna further comprises first and second conductor feed legs on respective opposing sides of the gap in said loop conductor.

11. The mobile wireless communications device according to claim 10, wherein said first and second conductor feed legs also position said loop conductor and first and second conductor bodies in spaced relation above said PCB.

12. The mobile wireless communications device according to claim 9, wherein each of said first and second conductor bodies has a rectangular shape.

13. The mobile wireless communications device according to claim 9, wherein said antenna further comprises a conductor arm extending outwardly from said loop conductor.

14. The mobile wireless communications device according to claim 13, wherein said conductor arm has a slotted opening therein.

15. The mobile wireless communications device according to claim 13, wherein said first slotted opening extends along said conductor arm.

16. A method making a mobile wireless communications device comprising a portable housing, a printed circuit board (PCB) carried by the portable housing, and wireless transceiver circuitry carried by the PCB, the method comprising:

forming an antenna to be coupled to the wireless transceiver circuitry by at least forming a loop conductor, forming a first conductor body coupled to the loop conductor and extending into an interior thereof to define a first slotted opening with adjacent portions of the loop conductor, and forming a second conductor body coupled to the loop conductor and extending into the interior thereof to define a second slotted opening with adjacent portions of the loop conductor, the first and second conductor bodies being spaced apart to define a third slotted opening therebetween, the first slotted opening having an enlarged width portion adjacent the first conductive body, the loop conductor being formed to have a gap therein between the first and second conductor bodies.

17. The method according to claim 16, wherein forming the antenna further comprises forming first and second conductor feed legs on respective opposing sides of the gap in the loop conductor.

18. The method according to claim 17, wherein forming the first and second conductor feed legs comprises forming the first and second legs to also position the loop conductor and first and second conductor bodies in spaced relation above the PCB.

19. The method according to claim 16, wherein forming the antenna further comprises forming a conductor arm to extend outwardly from the loop conductor.

* * * * *